US008480074B2

(12) United States Patent
Ubayashi et al.

(10) Patent No.: US 8,480,074 B2
(45) Date of Patent: Jul. 9, 2013

(54) SHEET FEEDING DEVICE AND IMAGE FORMING APPARATUS

(75) Inventors: Shinsuke Ubayashi, Kashiwa (JP); Shinichi Onodera, Tokyo (JP); Hajime Sekiguchi, Abiko (JP); Yuya Yokobori, Kashiwa (JP); Isao Kannari, Kashiwa (JP); Taro Ikeda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/316,787

(22) Filed: Dec. 12, 2011

(65) Prior Publication Data

US 2012/0153559 A1 Jun. 21, 2012

(30) Foreign Application Priority Data

Dec. 17, 2010 (JP) ..... 2010-281483

(51) Int. Cl.
*B65H 3/12* (2006.01)

(52) U.S. Cl.
USPC ..... 271/94; 271/98

(58) Field of Classification Search
USPC ..... 271/94, 97, 98, 152–155
See application file for complete search history.

(56) References Cited

U.S. PATENT DOCUMENTS

| | | | | |
|---|---|---|---|---|
| 5,478,066 | A | 12/1995 | Yoshida et al. | |
| 5,645,274 | A * | 7/1997 | Ubayashi et al. | 271/94 |
| 5,722,652 | A | 3/1998 | Yoshida et al. | |
| 6,082,728 | A | 7/2000 | Ubayashi | |
| 7,424,261 | B2 | 9/2008 | Uchida et al. | |
| 7,591,459 | B2 | 9/2009 | Matsumoto et al. | |
| 7,635,125 | B2 | 12/2009 | Ikeda | |
| 7,684,745 | B2 | 3/2010 | Uchida et al. | |
| 7,744,081 | B2 * | 6/2010 | Ikeda | 271/98 |
| 7,753,358 | B2 | 7/2010 | Ikeda | |
| 7,900,911 | B2 | 3/2011 | Ubayashi | |
| 8,083,223 | B2 | 12/2011 | Ikeda | |
| 2010/0194031 | A1 | 8/2010 | Ikeda et al. | |
| 2010/0295238 | A1 * | 11/2010 | Suzuki | 271/11 |

FOREIGN PATENT DOCUMENTS

| | | |
|---|---|---|
| JP | 7-196187 | 8/1995 |

* cited by examiner

*Primary Examiner* — Michael McCullough
(74) *Attorney, Agent, or Firm* — Fitzpatrick, Cella, Harper & Scinto

(57) ABSTRACT

Provided is a sheet feeding device having a sheet surface detecting mechanism installed to be movable up and down between adjacent adsorption conveyance belts 21, and detects a position of the top surface of the sheet by a sheet surface detecting member 61 that moves upward higher than the adsorbing surface of an adsorption conveyance belt 21. The position of the lower surface of the sheet surface detecting member 61 being pushed up by the blown upward sheet is regulated such that the difference in height between the adsorbing surface of the adsorption conveyance belt 21 and the lower surface of the sheet surface detecting member 61 is smaller than the difference in a height direction between the adsorbing surface of the adsorption conveyance belt 21 and the upper surface of a separation nozzle by a sensor abutting portion 62 that regulates upward movement of the sheet surface detecting member 61.

6 Claims, 9 Drawing Sheets

SHEET FEEDING DEVICE AND IMAGE FORMING APPARATUS

BACKGROUND OF THE INVENTION

1. Field of the Invention

The present invention relates to a sheet feeding device and an image forming apparatus, and more particularly to a technique of separating and feeding sheets by blowing air to the sheets.

2. Description of the Related Art

In the related art, an image forming apparatus, such as a printer or a copying machine, is equipped with a sheet feeding device which feeds sheets one by one from a sheet storage portion in which a plurality of sheets is stored. As this kind of sheet feeding device, there is an air sheet feeding system which blows air to the end of a sheet bundle stored in the sheet storage portion to blow up a plurality of sheets and causes only one sheet to be adsorbed onto an adsorption conveyance belt disposed above the sheet, thereby feeding the sheet (see Japanese Patent Laid-Open (JP-A) No. 7-196187).

In a sheet feeding device of this air sheet feeding system, a sheet tray, which stacks sheets in a sheet storage portion where multiple sheets are stored, is configured to be able to be lifted and lowered. In addition, on top of a sheet storage case are provided an adsorption conveying portion and an air blowing portion. The adsorption conveying portion adsorbs and conveys a sheet and the air blowing portion blows air to the end of a sheet bundle on the sheet tray to blow upward a plurality of sheets in order to separate the sheets one by one.

Further, in the case of feeding sheets by adsorption, the sheets are conveyed in such a manner that an air blowing portion blows air to an upper portion of a sheet bundle which is stacked on a sheet tray to blow upward a plurality of sheets and an adsorption conveying portion adsorbs and conveys the top sheet out of the blown-upward sheets. Here, this kind of air sheet feeding system is adopted in a highly productive apparatus which can feed 70 sheets or more of A4 size or Letter size per minute. In this apparatus, the sheet tray is usually equipped with a lifting mechanism which is moved in a vertical direction while keeping its posture horizontal.

In addition, this kind of sheet feeding device is also equipped with a sheet surface detecting mechanism which controls the position of the top surface of a sheet bundle which is stored in the sheet storage case. This sheet surface detecting mechanism is equipped with a sheet surface detecting member which is installed to be able to be lifted and lowered while keeping its parallel (horizontal) posture, and is lifted up by being pushed up by the top sheet blown upward due to the air which is blown by the air blowing portion (see U.S. Pat. No. 7,744,081 B2). Accordingly, the height of the top surface of the sheet bundle can be appropriately controlled by detecting a change in the output of a sensor in response to an upward motion of the sheet surface detecting member, and thus the sheet bundle can reliably be separated when a sheet is adsorbed onto the adsorption conveyance belt.

Furthermore, this sheet surface detecting member usually extends downward from between the adsorption conveyance belts, but when the sheet is adsorbed onto the adsorption conveyance belt, the sheet surface detecting member retracts into an adsorption duct by being pushed by the sheet, so as not to hinder the sheet from being adsorbed onto the adsorption conveyance belt.

On the other hand, sometimes the sheet which has a weak rigidity and is thin to have a basic weight of about 50 g/m$^2$ is adsorbed and fed in this kind of a related art sheet feeding device. In this case, when the sheet is adsorbed onto the adsorption conveyance belt, as illustrated in FIG. 9A, the sheet S deflects upward, and thus ends up entering into the adsorption duct 51 through a storage hole 51H1, provided for storage of the sheet surface detecting member 161, formed at the bottom of the adsorption duct 51 along with the sheet surface detecting member 61.

In this case, when the adsorption conveyance belt 21 rotates as it is, an upwardly protruding curve-shaped deflection Q1 of the sheet S which has entered into the storage hole 51H1 gets out of the storage hole 51H1. However, when it gets out of the storage hole 51H1, it then reaches the point where the end of the sheet in the sheet conveying direction deflects downward due to the rigidity of sheet S. When the sheet deflects downward in this way, as illustrated in FIG. 9B, this deflection Q2 may be caught by a guide plate 35 which guides the sheet or by the end of an air blowing nozzle (not illustrated) or the like, or may be strongly pressed against the surface of the guide plate, so that a paper jam occurred in many cases.

This invention is made in view of the above circumstances, and thus the invention provides a sheet feeding device and an image forming apparatus which are able to feed a sheet while preventing a sheet from being caught even when using a thin sheet.

SUMMARY OF THE INVENTION

A sheet feeding device includes a tray that supports the sheets, an air blowing portion that blows air at an upper portion of the sheets on the tray to blow upward the sheets, a plurality of endless-type adsorption conveyance belts that is arranged to be parallel to a sheet feeding direction and that adsorbs and conveys the blown upward sheet, a guide member that is disposed on the downstream of the adsorption conveyance belts in the sheet feeding direction and under the adsorption conveyance belts, thereby guiding the underside of the sheet conveyed by the adsorption conveyance belt, a suction duct that generates an adsorption force with respect to the adsorption conveyance belts, a lever that is installed to be movable up and down between the plurality of adsorption conveyance belts, and that moves upward higher than an adsorbing surface of the adsorption conveyance belt that adsorbs the sheet, from a position below the adsorption conveyance belt by being pushed up by the blown-upward sheet, a sheet surface detecting mechanism that detects a position of the top surface of the blown-up sheet, based on the position of the lever, and a regulating portion that regulates the lever that is pushed up by the blown-upward sheet such that a difference in height between the adsorbing surface of the adsorption conveyance belt and a lower surface of the lever pushed up by the blown-upward sheet is smaller than a difference in a height direction between the adsorbing surface of the adsorption conveyance belt and the guide member.

According to the present invention, it is possible to feed a sheet while preventing a sheet from being caught even when using a thin sheet by regulating the position of the lower surface of the lever to be kept at a position which satisfies the condition in which the difference in height between the adsorbing surface of the adsorption conveyance belt and the lower surface of the lever is smaller than the difference in the height direction between the adsorbing surface of the adsorption conveyance belt and the guide member.

Further features of the present invention will become apparent from the following description of exemplary embodiments with reference to the attached drawings.

DESCRIPTION OF THE EMBODIMENTS

Figure 1:
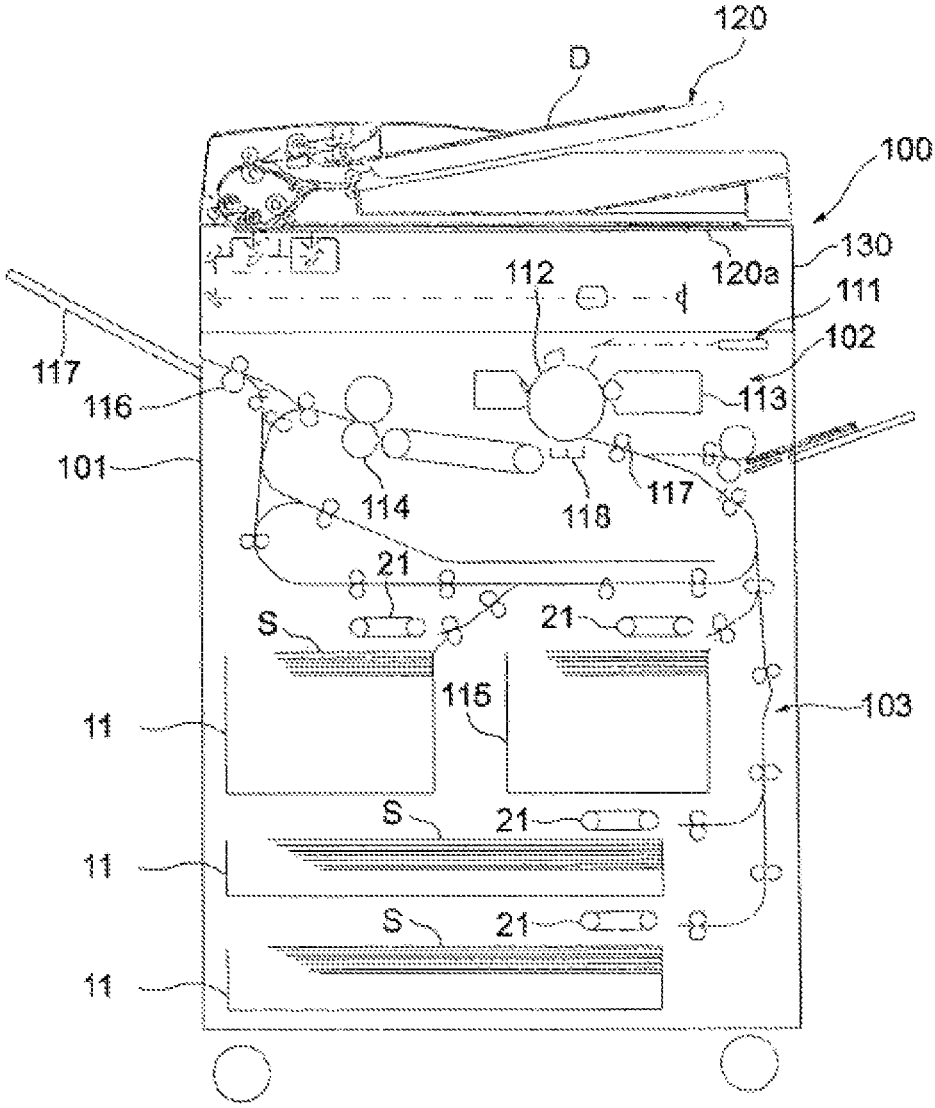
FIG. 1 is a diagram schematically illustrating the overall structure of a printer which is an example of an image forming apparatus which includes a sheet feeding device according to an embodiment of the present invention.

Hereinafter, embodiments of the present invention will be described in detail with reference to the drawings. FIG. 1 is a diagram schematically illustrating the outline structure of a printer which is an example of an image forming apparatus which includes a sheet feeding device according to an embodiment of the present invention. As illustrated in FIG. 1, a printer 100 includes a printer body 101. On top of the printer body 101 is provided an image reading portion 130 which reads an original D placed on a platen glass 120*a* serving as an original placing platen with an automatic original feeder 120. In addition, under the image reading portion 130, an image forming portion 102 and a sheet feeding device 103 which feeds a sheet S to the image forming portion 102 are provided.

The image forming portion 102 includes a photosensitive drum 112, a development device 113, and a laser scanner portion 111 and the like. In addition, the sheet feeding device 103 includes a plurality of sheet storage cases 11, which store sheets S of OHT or the like therein and are removably attached to the printer body 101, and an adsorption conveyance belt 21 which is a conveyance belt as an example of a sheet feeding unit which sends out the sheet S stored in the sheet storage cases 11. The structure which adsorbs and sends out the sheet, including the adsorption conveyance belt 21, may be embodied into one unit.

Next, the image forming operation of the printer 100 configured in this manner will be described. When a controller (not illustrated) provided in the printer body 101 outputs an image reading signal to the image reading portion 130, the image reading portion 130 reads an image. After this, a laser scanner portion 111 irradiates a laser light beam which corresponds to this electric signal onto the photosensitive drum 112. For this case, the photosensitive drum 112 has been electrically charged in advance, and thus an electrostatic latent image is formed with the light irradiated. Next, the development device 113 develops the electrostatic latent image to form a toner image on the photosensitive drum 112.

On the other hand, when the controller outputs a paper feed signal to the sheet feeding device 103, the sheet S is fed from the sheet storage case 11. After that, the sheet S fed is sent to a transfer portion, which is configured with the photosensitive drum 112 and a transfer charger 118, by a registration roller 117 in synchronization with the toner image on the photosensitive drum 112.

Next, the toner image is transferred to the sheet which is sent to the transfer portion, and then the sheet is conveyed to a fixing portion 114. After that, the sheet S is applied with heat and pressure by the fixing portion 114 and thus the transferred image which has not yet fixed to the sheet S becomes permanently fixed to the sheet S. The sheet, to which an image is fixed in the manner described above, is discharged to a discharge tray 119 from the printer body 101 by a discharging roller 116.

Figure 2:
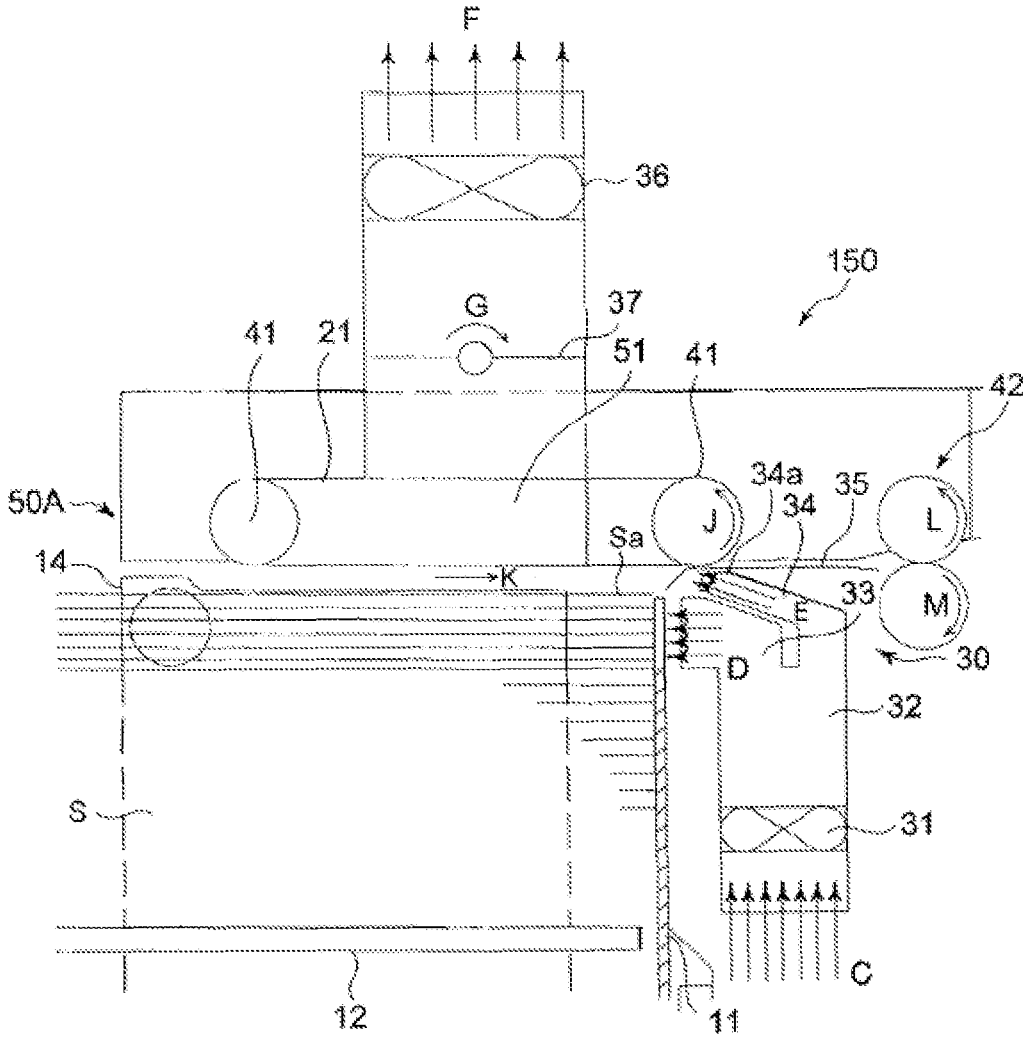
FIG. 2 is a diagram illustrating the structure of the sheet feeding device.

FIG. 2 is a diagram illustrating the structure of the sheet feeding device 103. As illustrated in FIG. 2, the sheet feeding device 103 includes a sheet storage case 11, a sheet tray 12 installed to be lifted and lowered, a side end regulating plate 14 which regulates the position of the sheet S in a width direction which is orthogonal to the sheet feeding direction, and a rear end regulating plate (not illustrated) which regulates the upstream end (rear end) of the sheet S in the sheet feeding direction. The rear end regulating plate and the side end regulating plate 14 are configured to change their positions according to the size of the sheet stored. In addition, the sheet storage case 11 can be pulled out of the printer body 101 with aid of a slide rail (not illustrated).

Furthermore, on top of this sheet storage case 11 is disposed a sheet feeding mechanism of an air sheet feeding system (hereinafter, referred to as an air sheet feeding mechanism 150) which feeds the sheets one by one by separating the sheets. This air sheet feeding mechanism 150 includes an adsorption conveying portion 50A, which is assembled into a unit and which conveys the sheets S stacked on the sheet tray 12 by adsorption, and an air blowing portion 30 which blows upward sheets at an upper portion of a sheet bundle stacked on the sheet tray and separates the sheets S one by one.

Here, the adsorption conveying portion 50A includes an adsorption conveyance belt 21 of an endless type and an adsorption fan 36. The adsorption conveyance belt 21 is stretched over a belt drive roller 41, and adsorbs and feeds the sheet S to the right in the drawing. The adsorption fan 36 generates a negative pressure in order to cause the sheet S to be adsorbed onto the adsorption conveyance belt 21. The adsorption conveying portion 50A further includes a suction duct 51 which is disposed inside the adsorption conveyance belt 21 to suck the air through a suction hole 21A formed in the adsorption conveyance belt 21 as illustrated in FIG. 5.

Furthermore, the adsorption conveying portion 50A includes an adsorption shutter 37, which is disposed between the adsorption fan 36 and the suction duct 51 to turn on/off an adsorption operation of the adsorption conveyance belt 21. In addition, in the present embodiment, there are three adsorption conveyance belts 21 arranged at predetermined intervals in a width direction as illustrated in FIG. 5.

Further, the air blowing portion 30 includes a loosening nozzle 33 and a separation nozzle 34 for blowing air to the upper end (side surface) of the stored sheets S, a separation fan 31, a separation duct 32 which sends air from the separation fan 31 to each of the nozzles 33 and 34. Part of the air which is sucked in the direction of an arrow C by the separation fan 31 passes through the separation duct 32, and is then blown in the direction of an arrow D by the loosening nozzle 33. This blows upward several sheets S of paper on top of the sheets S stacked in the sheet tray 12. The other part of the air is blown in the direction of an arrow E by the separation nozzle 34 to separate the sheets which stay aloft due to the loosening nozzle 33 one by one so that the sheet can be adsorbed onto the adsorption conveyance belt 21.

The sheet conveyed while being kept adsorbed onto the adsorption conveyance belt 21 is transferred to a pair of drawing rollers 42. A guide plate 35 is disposed between the adsorption conveying portion 50A and the pair of drawing rollers 42 to guide the leading end of the sheet to the pair of drawing rollers 42. The upstream end of the guide plate 35 extends up to the lower side of the adsorption conveyance belt 21. The air blowing portion 30 is disposed at the center of the guide plate 35 which faces the adsorption conveying portion 50A. Accordingly, the upstream end of the guide plate 35 is partially cut off and an upper portion of the air blowing portion 30 is disposed in the cut-off portion.

In addition, the upper surface 34*a* of the separation nozzle 34 of the air blowing portion 30 has almost the equal height to the upper surface of the guide plate 35 or slightly protrudes from the upper surface of the guide plate 35, thereby constituting the guide member according to the present invention which guides the sheet adsorbed onto and conveyed by the adsorption conveyance belt 21. Furthermore, in the present embodiment, the upper surface 34*a* of the separation nozzle 34 is described as an example of the guide member of the present invention. However, in a device in which the upper surface 34*a* of the separation nozzle 34 is positioned to be lower than the guide plate 35, the guide plate 35 may be used as a guide member.

The following description is about the sheet feeding operation of the sheet feeding device 103 (air sheet feeding mechanism 150) having the structure described above. First, a user pulls out the sheet storage case 11, and then sets the sheets S therein. After this, the sheet storage case 11 is mounted at a predetermined position, and the sheet tray 12 starts to be lifted. Eventually, when sheet tray 12 reaches to a feedable position where the distance between the top surface of the sheet bundle on the sheet tray 12 and the adsorption conveyance belt 21 is a predetermined distance, the controller makes the sheet tray 12 halt at this position. After this, the controller awaits a sheet feeding signal which initiates the feed of the sheet.

Next, when the sheet feeding signal is detected, the controller operates the separation fan 31 so that the air will be sucked in the direction of an arrow C. This air passes through the separation duct 32 and is blown to the sheet bundle in the directions of arrows D and E from the loosening nozzle 33 and the separation nozzle 34, respectively. Because of this, several top sheets of the sheet bundle are blown upward. Next, the controller operates the adsorption fan 36 to eject the air in the direction of an arrow F. In this case, the adsorption shutter 37 is kept closed.

Next, when a predetermined time has elapsed after detection of the sheet feeding signal and the blown-upward top sheets are settled, the controller turns the adsorption shutter 37 in the direction of an arrow G to generate a suction force which is exerted from the suction hole formed in the adsorption conveyance belt 21. Then, thanks to this suction force and the blowing of the separation air from the separation nozzle 34, only the top sheet Sa is adsorbed onto the adsorption conveyance belt 21.

Subsequently, the controller rotates the drive roller 41 in the direction of an arrow J. With this rotation, the top sheet Sa is fed in the direction of an arrow K while it is kept adsorbed onto the adsorption conveyance belt 21. After this, the sheet Sa is sent to an image forming portion by the pair of drawing rollers 42 which rotate in the directions of arrows L and M. In addition, the sheet, which has passed through the adsorption conveyance belt 21, is supported from its underside on the upper surface 34*a* of the separation nozzle 34, serving as the guide member, which is arranged on the downstream of the adsorption conveyance belt 21 in the sheet feeding direction and positioned under the adsorption conveyance belt 21, and is conveyed more downstream in that state.

Meanwhile, in order to cause the sheet S to be adsorbed onto the adsorption conveyance belt 21, the upper surface of the top sheet Sa of the sheet bundle stored in the sheet storage case 11 needs to be maintained at a predetermined position where the top sheet Sa is able to be adsorbed onto the adsorption conveyance belt 21. For this reason, the sheet feeding device 103 is equipped with an upper-surface detecting mechanism which detects the upper surface of the top sheet Sa in order to make the upper surface of the top sheet Sa of the sheet bundle stacked in the sheet tray 12 keep staying at a predetermined position where the adsorption conveying portion 50A can perform the adsorption and conveyance of the sheet.

Figure 3:
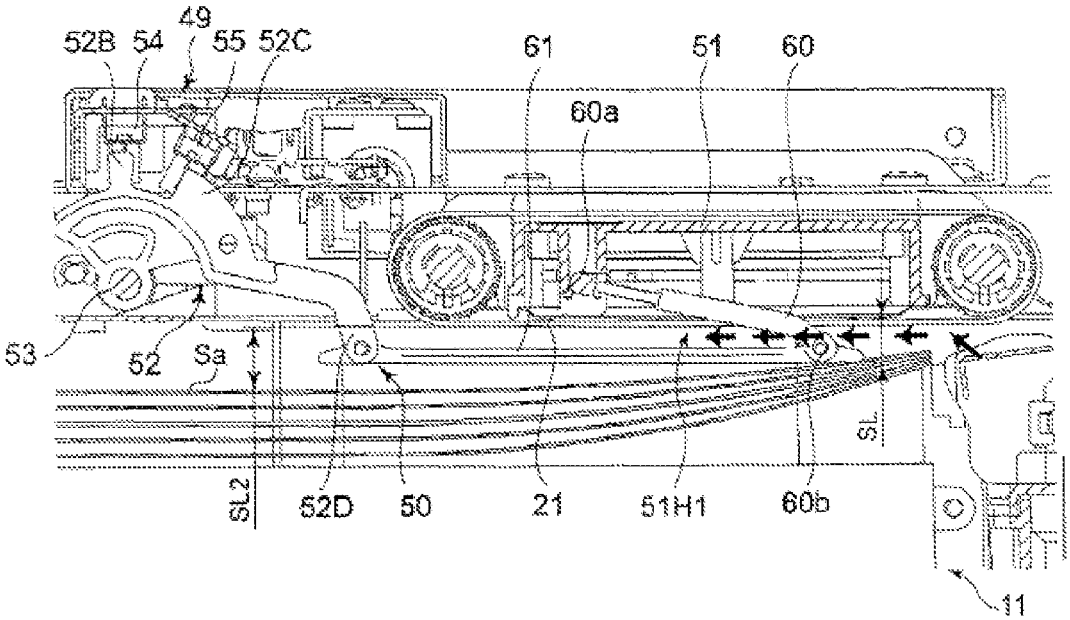
FIG. 3 is a diagram illustrating the structure of a sheet surface detecting mechanism provided in the sheet feeding device.

FIG. 3 is a diagram illustrating the structure of such a sheet surface detecting mechanism. The sheet surface detecting mechanism 49 includes a first sheet surface sensor 54, a second sheet surface sensor 55, and a sensor flag mechanism 50.

Here, the sensor flag mechanism 50 includes a support member 60 which is installed to be freely turnable in the suction duct 51, and a sheet surface detecting sensor flag 52 which individually turns on/off the first and second sheet surface sensors 54 and 55.

In addition, the sensor flag mechanism 50 includes a sheet surface detecting member 61 which is installed to be movable in a vertical direction between the adsorption conveyance belts 21 parallel to each other, and which is a lever supported to be movable in the vertical direction by the support member 60 and the sheet surface detecting sensor flag 52. The support member 60, the sheet surface detecting sensor flag 52, and the sheet surface detecting member 61 constitute a parallel link. With this mechanism, at which position the sheet abuts within the range of the length of the sheet surface detecting member 61, the sheet surface detecting member 61 can move in the vertical direction while keeping its body horizontal.

Furthermore, this sheet surface detecting member 61 is configured to be able to move upward by being pushed up by the blown-upward sheet, from below the adsorption conveyance belt 21 to a higher position than the adsorbing surface of the adsorption conveyance belt 21 onto which the sheet is adsorbed.

The support member 60 which is supported inside the suction duct in a freely turnable manner extends from a storage hole 51H1 used for storage of the sheet surface detecting member, which is formed in a gap, in the width direction, between a plurality of adsorption conveyance belts 21 as illustrated in FIG. 5, and protrudes below the adsorption conveyance domain of the adsorption conveyance belt 21.

In addition, the sheet surface detecting sensor flag 52, the first sheet surface sensor 54, and the second sheet surface sensor 55 are disposed at a position displaced from the adsorption conveyance domain (the belt surface on the side where the sheet is adsorbed) of the adsorption conveyance belt 21 to the upstream in the sheet feeding direction.

Here, the sheet surface detecting sensor flag 52 includes a support portion 52D which is supported on a support shaft 53 in a freely turnable manner, and supports the sheet surface detecting member 61 in a freely turnable manner. The sheet surface detecting flag sensor 52 further includes a first detecting portion 52B which shades a light receiving portion of the first sheet surface sensor 54, and a second detecting portion 52C which shades the second sheet surface sensor 55.

The controller (not illustrated) performs control such that the upper surface of the top sheet Sa stay within an appropriate height range by detecting the position of the upper surface of the top sheet Sa of the sheet bundle stored in the sheet storage case 11 with use of the sheet surface detecting mechanism 49 described above. Furthermore, since the height of the top surface of the sheet bundle is appropriately controlled, the sheet adsorbed onto the adsorption conveyance belt 21 can be surely separated, and thus the sheets can be fed toward the image forming portion one after another. As a result, a stable sheet feeding operation can be achieved.

Furthermore, the sheet surface detecting member 61 is pushed up and hence moves upward by being pushed by the adsorbed top sheet Sa, and then retracted into the suction duct through the storage hole 51H1 which is an opening, in order to prevent the sheet from not being adsorbed when the sheet is adsorbed onto the adsorption conveyance belt 21.

Next, the control on the sheet surface which is based on the detection by the sheet surface detecting mechanism 49 of the controller will be described. When the sheet, which is stored in the sheet storage case 11, is lifted along with the rise of the sheet tray 12 and thus the upper surface of the top sheet abuts against the sheet surface detecting member 61 of the sensor flag mechanism 50, the sheet surface detecting member 61 is pushed up by the top sheet and thus is lifted.

Figure 4A:
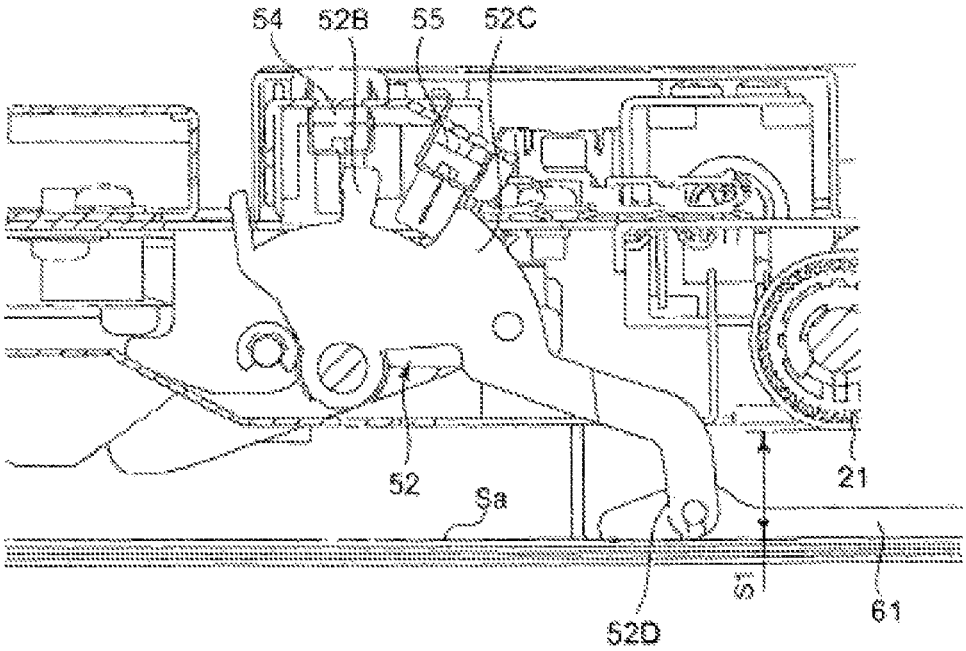
FIG. 4A is a diagram for explaining control on a sheet surface which is based on detection by the sheet surface detecting mechanism.

With the rise of the sheet detecting member 61, the sheet surface detecting sensor flag 52 turns about the support shaft 53. After this, as illustrated in FIG. 4A, when the distance S1 between the belt surface of the adsorption conveyance belt 21 and the upper surface of the top sheet Sa is proper, the first sheet surface sensor 54 is shaded by the first detecting portion 52B of the sheet surface detecting sensor flag 52, and outputs an ON signal. In addition, the second sheet surface sensor 55 is shaded by the second detecting portion 52C of the sheet surface detecting sensor flag 52, and outputs an ON signal. In this way, the first sheet surface sensor 54 and the second sheet surface sensor 55 output the ON signals, and the sheet tray 12 stops rising.

Next, when a feed start signal is received, the controller causes the air to start blowing so that the sheets are blown upward. After that, the top sheet Sa is controlled to be blown upward at a set area by lifting or lowering the sheet tray 12. In the present embodiment, the position where the second sheet surface sensor 55 outputs the ON signal is set as the lower limit of the blowing-upward area. Then, even though the ON signal is output from a first sheet surface sensor 54, when the ON signal of the second sheet surface sensor 55 cannot be acquired, the position is determined to be "too low", so that the sheet tray 12 is lifted up to the position where the ON signal is acquired.

Figure 4B:
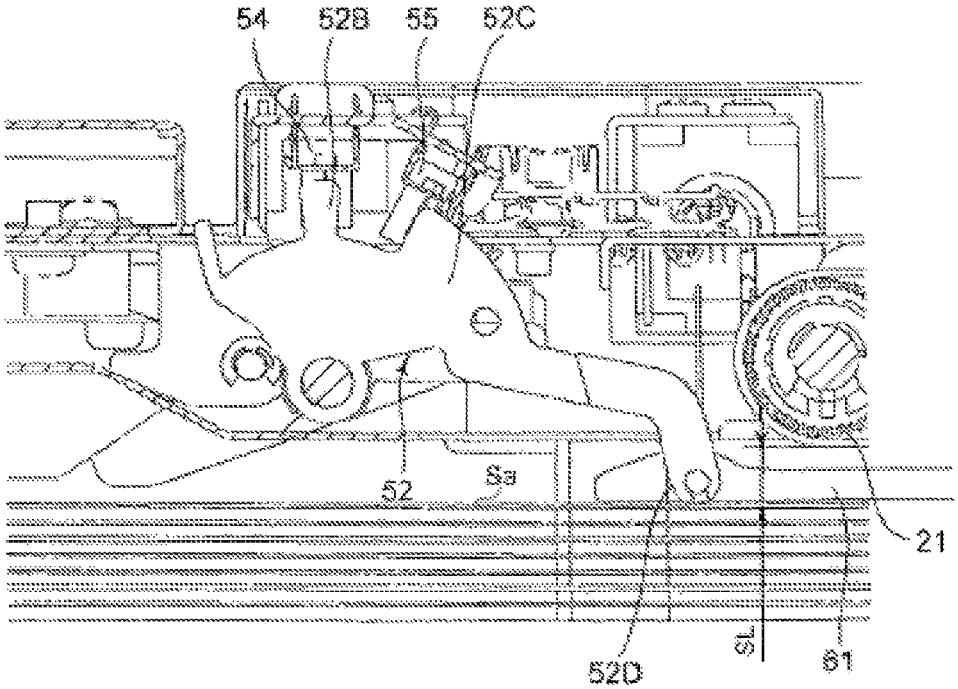
FIG. 4B is a diagram for explaining control on a sheet surface which is based on the detection by the sheet surface detecting mechanism.

In addition, as illustrated in FIG. 4B, when the distance SL between the adsorption conveyance belt 21 and the upper surface of the top sheet Sa is smaller than a set distance, the shading by the first detecting portion 52B is cancelled, and the ON signal cannot be output from the first sheet surface sensor 54. Accordingly, in this way, the position where the ON signal is not output from the first sheet surface sensor 54 is set as the upper limit of the blowing-upward area. Further, when the ON signal of the first sheet surface sensor 54 is not acquired, the position is determined to be "too high", so that the sheet tray 12 is lowered up to the position where the ON signal is acquired.

Figure 5A:
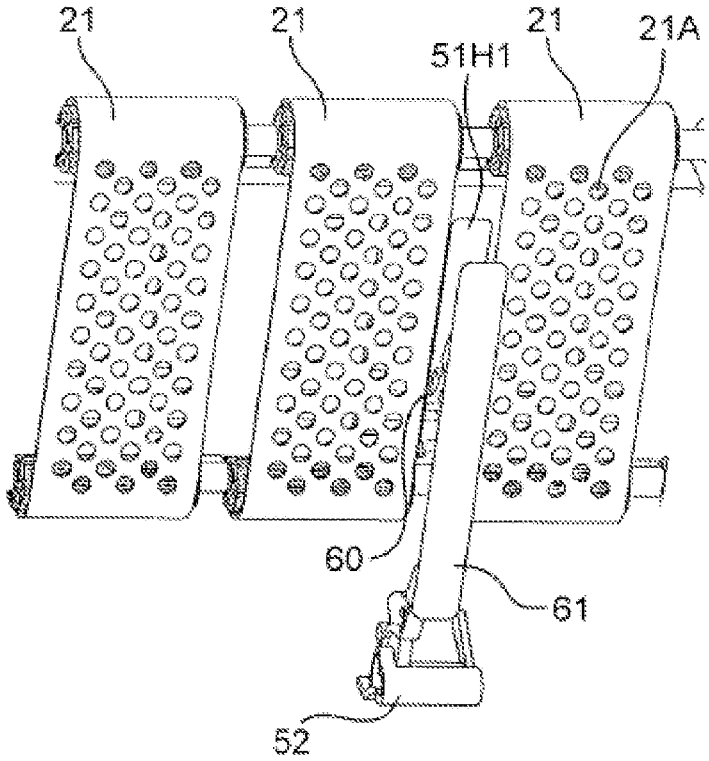
FIG. 5A is a diagram for illustrating operation of a sheet surface detecting member which is provided in the sheet surface detecting mechanism.
Figure 5B:
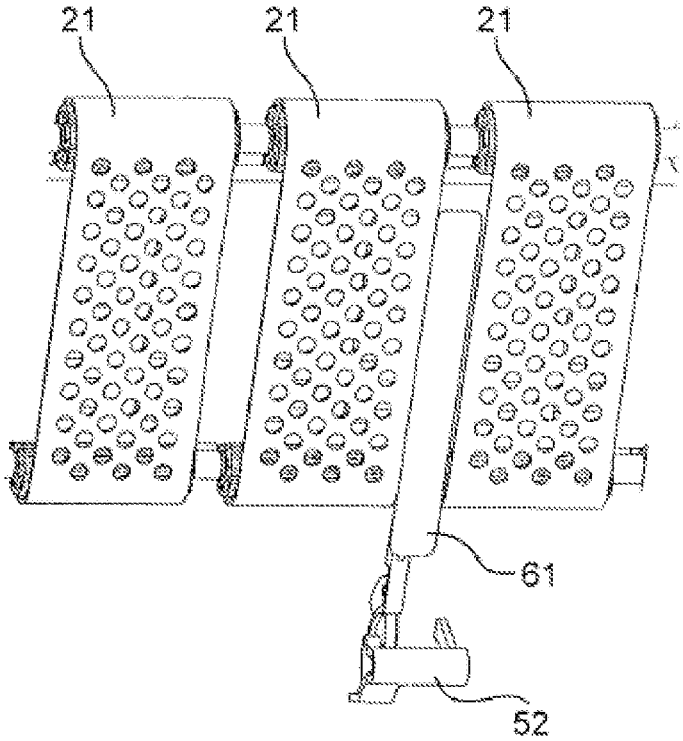
FIG. 5B is a diagram for explaining operation of the sheet surface detecting member which is provided in the sheet surface detecting mechanism.

On the other hand, as described above, the sheet surface detecting member 61, as illustrated in FIG. 5A, protrudes below the adsorption conveyance domain of the adsorption conveyance belt 21 from the storage hole 51H1. When the top sheet Sa is blown upward, the sheet surface detecting member 61 is pushed by the top sheet Sa and is retracted into the storage hole 51H1 as illustrated in FIG. 5B.

Figure 6:
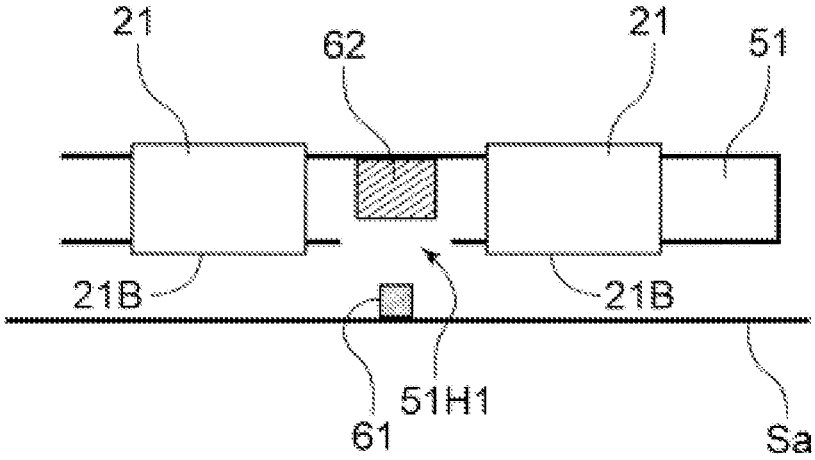
FIG. 6 is a diagram for explaining a sensor abutting portion provided in the sheet feeding device.
Figure 7A:
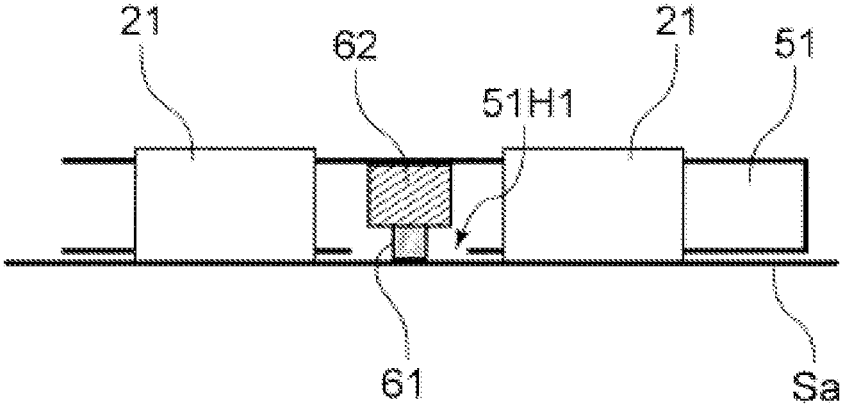
FIG. 7A is a diagram for explaining action of the sensor abutting portion.

In the present embodiment, as illustrated in FIG. 6, the top face which faces the storage hole 51H1 of the suction duct 51 is provided with a sensor abutting portion 62, which is a regulating portion for regulating the upward movement of the sheet surface detecting member 61 pushed up by the blown-upward sheet. Furthermore, FIG. 6 illustrates an adsorbing surface 21B which faces the sheet on the sheet adsorption conveyance belt 21 and which adsorbs the sheet thereon. When the sheet surface detecting member 61 is pushed up by the top sheet Sa and is retracted into the suction duct through the storage hole 51H1, as illustrated in FIGS. 7A and 7B, the sheet surface detecting member 61 is disposed so as to abut against the sensor abutting portion 62.

Figure 7B:
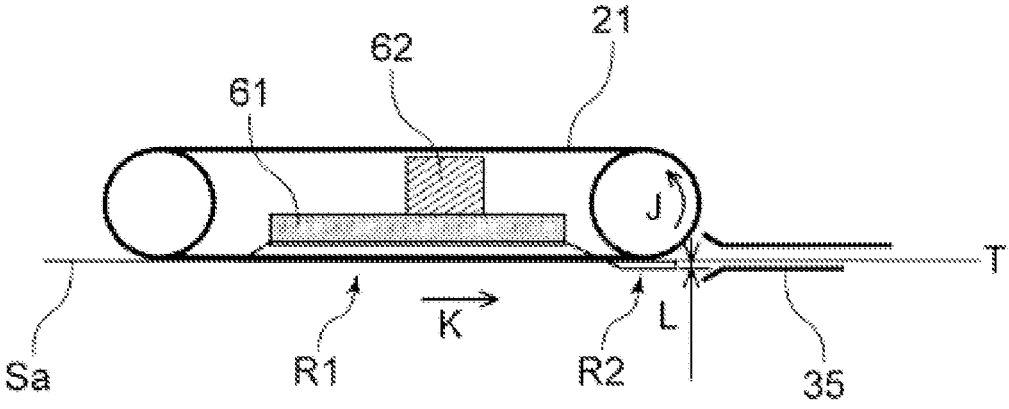
FIG. 7B is a diagram for explaining action of the sensor abutting portion.

Here, in this way, when the sheet surface detecting member 61 abuts against the sensor abutting portion 62, as illustrated in FIG. 7B, a lower surface of the sheet surface detecting member 61 may not externally protrude from the surface T which connects the adsorbing surface of the adsorption conveyance belt 21. In addition, the sheet surface detecting member 61 does not enter inside the storage hole 51H1 by as much as the distance L in the height direction from the surface T to the upper surface 34*a* (leading end) of the separation nozzle 34 serving as a guide member.

In this way, by regulating the position of the lower surface of the sheet surface detecting member 61 with the use of the sensor abutting portion 62, even in a case where a relatively thin sheet is used, when the sheet Sa is adsorbed, the distance that the sheet Sa enters the storage hole 51H1 may be suppressed to the distance S from the surface T or less. Accordingly, when the sheet Sa is adsorbed, the sheet Sa may enter the storage hole 51H1 but an upwardly protruding convex deflection R1 of the sheet Sa may be reduced.

Since the upwardly protruding convex deflection R1 is reduced, when the sheet Sa is conveyed and has passed through the area of the storage hole 51H1 thereafter, even though the sheet deflects in a downward protruding convex form due to the repulsive force, the amount of the deflection R2 is smaller than the distance L. Accordingly, the deflection R2 of the sheet Sa is neither caught by the leading end of the upper surface 34*a* of the separation nozzle 34 serving as the guide member, nor be strongly pressed against the guide plate 35.

In this way, in the present embodiment, the position of the lower surface of the sheet surface detecting member 61 is regulated with the sensor abutting portion 62. That is, the lower surface of the sheet surface detecting member 61 is regulated to be kept at a position where the difference in height between the adsorbing surface 21B of the adsorption conveyance belt 21 and the lower surface of the sheet surface detecting member 61 is smaller than the difference in the height direction between the adsorbing surface 21B of the adsorption conveyance belt 21 and the upper surface 34*a* of the separation nozzle 34. In this way, even thin sheets can be fed without being caught.

Furthermore, the above description which has been made so far concerns about the structure in which the position, in terms of height, of the lower surface of the sheet surface detecting member 61 is regulated by arranging the sensor abutting portion 62 as a regulating portion on the top face of the suction duct 51. However, the present invention is not limited to that structure. For example, for the same purpose, the sheet surface detecting member may be provided with a regulating portion.

Figure 8A:
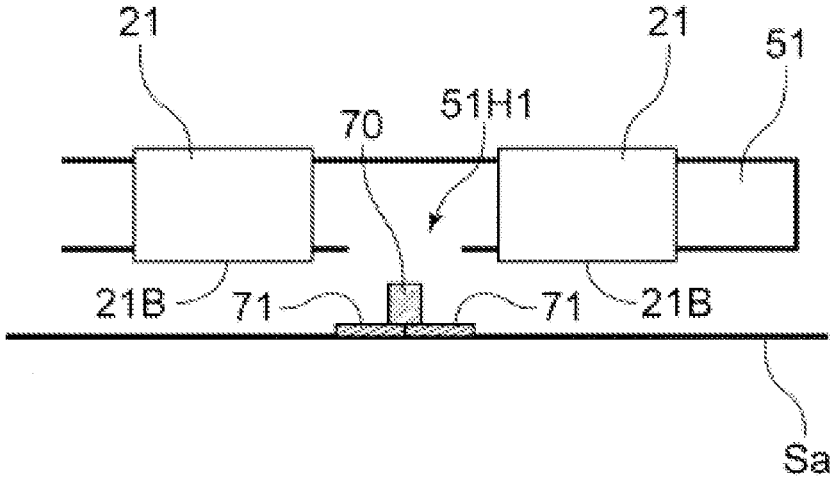
FIG. 8A is a diagram for illustrating the structure of a sheet surface detecting member provided in a sheet feeding device according to a second embodiment of the present invention.
Figure 8B:
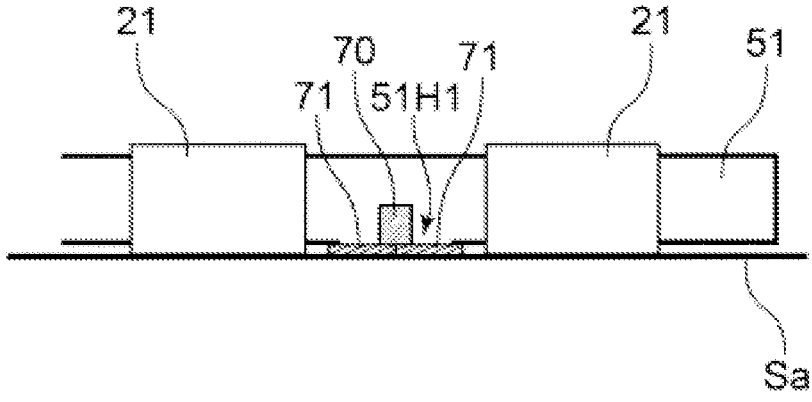
FIG. 8B is a diagram for explaining the structure of the sheet surface detecting member provided in the sheet feeding device according to the second embodiment of the present invention.
Figure 9A:
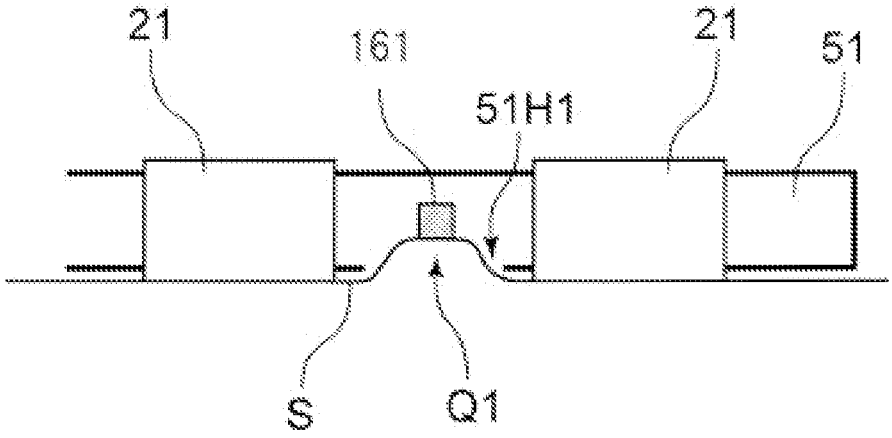
FIG. 9A PRIOR ART
FIG. 9A is a diagram for explaining the structure of a sheet feeding device according to an example of the related art.
Figure 9B:
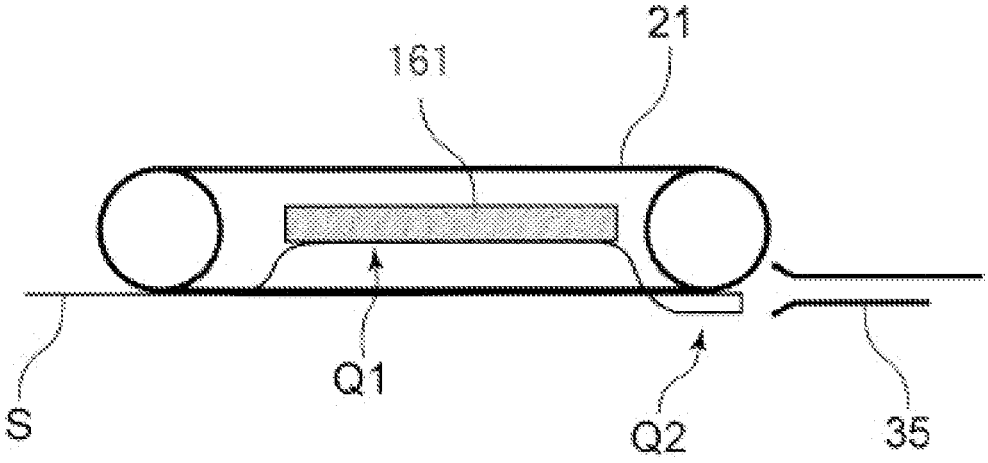
FIG. 9B PRIOR ART
FIG. 9B is a diagram for explaining the structure of a sheet feeding device according to an example of the related art.

Next, a second embodiment of the present invention will be described in which a sheet surface detecting member is provided with a regulating portion. FIGS. 8A and 8B are diagrams for explaining the structure of a sheet surface detecting member provided in a sheet feeding device according to the present embodiment. In FIGS. 8A and 8B, the same reference symbols as in FIG. 6 represent the same or corresponding portions as in FIGS. 8A and 8B.

In FIGS. 8A and 8B, a sheet surface detecting member 70 normally protrudes from the lower side of an adsorption conveyance area of an adsorption conveyance belt 21 as illustrated in FIG. 8A. Here, in the present embodiment, on both sides of the sheet surface detecting member 70 which are parallel to a sheet feeding direction, an abutting portion 71 which abuts against the underside of the periphery of the storage hole 51H1 of the suction duct 51 is provided.

When the top sheet Sa is blown upward and the sheet surface detecting member 70 is pushed so as to rise by the sheet Sa, as illustrated in FIG. 8B, the abutting portion 71 abuts against the periphery portion of the storage hole 51H1 from the underside. In this way, even though the sheet surface detecting member 70 is pushed up by the top sheet Sa, the sheet surface detecting member 70 is not likely to enter the suction duct.

In this way, since the sheet surface detecting member 70 is prevented from entering the suction duct, a thin sheet Sa also does not enter the storage hole 51H1 while being kept adsorbed, and thus the sheet does not deflect. Consequently, after that, when the sheet Sa is conveyed and then passes through the area of the storage hole 51H1, the sheets Sa does not deflect downward, and hence are not be caught by the upper surface 34*a* of the separation nozzle 34. Accordingly, even thin sheets can be fed without being caught.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-281483, filed Dec. 17, 2010, which is hereby incorporated by reference herein in its entirety.

What is claimed is:

1. A sheet feeding device comprising:

a tray that supports sheets;

an air blowing portion that blows air at an upper portion of the sheets on the tray to blow upward the sheets;

a plurality of endless adsorption conveyance belts that is arranged to be parallel to a sheet feeding direction and that adsorbs and conveys the blown-upward sheet;

a guide member that is disposed downstream of the plurality of the adsorption conveyance belts in the sheet feeding direction and under the plurality adsorption conveyance belts, thereby guiding the underside of a sheet conveyed by the plurality of the adsorption conveyance belt;

a suction duct that generates an adsorption force with respect to the plurality of the adsorption conveyance belts;

a lever that is installed to be movable up and down between the plurality of adsorption conveyance belts, and that moves upward to a position higher than an adsorbing surface of the plurality of the adsorption conveyance belts that adsorbs a sheet from a position below the plurality of the adsorption conveyance belts by being pushed up by the blown-upward sheet;

a sheet surface detecting mechanism that detects a position of the top surface of the blown-upward sheet based on the position of the lever; and an abutting portion against which the lever pushed up by the blown-upward sheet is abutted so that when the abutting portion abuts upper surface of the lever pushed up by the blown-upward sheet, the abutting portion regulates a position of the lever that is pushed up by the blown-upward sheet such that a difference in height between the adsorbing surface of the plurality of the adsorption conveyance belts and a lower surface of the lever pushed up by the blown-upward sheet is smaller than a difference in a height direction between the adsorbing surface of the plurality of the adsorption conveyance and the guide member.

2. The sheet feeding device according to claim 1, wherein the suction duct is provided with an opening that receives the lever pushed up by the blown-up sheet, and the abutting portion is provided inside the suction duct at a position where the abutting portion faces the opening, and the abutting portion regulates upward movement of the lever by abutting against the lever pushed up by a blown-upward sheet.

3. The sheet feeding device according to claim 1, wherein the abutting portion is positioned above the lever.

4. The sheet feeding device according to claim 1, wherein the lever separates from the abutting portion when the lever is not pushed up by a sheet.

5. An image forming apparatus comprising:

a sheet feeding device that feeds a sheet and an image forming portion that forms an image on a sheet fed by the sheet feeding device, wherein the sheet feeding device includes:

a tray that supports sheets;

an air blowing portion that blows air at an upper portion of sheets on the tray to blow upward the sheets;

a plurality of endless adsorption conveyance belts that is arranged to be parallel to a sheet feeding direction to adsorb and convey a blown-upward sheet;

a guide member that is disposed downstream of the plurality of the adsorption conveyance belts in the sheet feeding direction and under the adsorption conveyance belt to guide the underside of a sheet conveyed by the plurality of the adsorption conveyance belts;

a suction duct that generates an adsorption force with respect to the plurality of the adsorption conveyance belts;

a lever that is installed to be movable up and down between the plurality of adsorption conveyance belts, and that moves upward to a position higher than an adsorbing surface of the plurality of the adsorption conveyance belts that adsorbs a sheet, from a position below the plurality of the adsorption conveyance belts by being pushed up by the blown-upward sheet;

a sheet surface detecting mechanism that detects a position of the top surface of the blown-upward sheet, based on the position of the lever;

an abutting portion against which the lever pushed up by the blown-upward sheet is abutted so that when the abutting portion abuts upper surface of the lever pushed up by the blown-upward sheet, the abutting portion regulates a position of the lever that is pushed up by a blown-upward sheet such that a difference in height between the adsorbing surface of the plurality of the adsorption conveyance belts and a lower surface of the lever pushed up by a blown-upward sheet is smaller than a difference in a height direction between the adsorbing surface of the plurality of the adsorption conveyance belts and the guide member.

6. The image forming apparatus according to claim 5, wherein the suction duct is provided with an opening that receives the lever pushed up by a blown-upward sheet, and the abutting portion is provided inside the suction duct at a position where the abutting portion faces the opening, and the abutting portion regulates upward movement of the lever by abutting against the lever pushed up by a blown-upward sheet.

* * * * *